United States Patent [19]

Batey

[11] Patent Number: 4,535,236

[45] Date of Patent: Aug. 13, 1985

[54] APPARATUS FOR AND METHOD OF OPERATING QUADRUPOLE MASS SPECTROMETERS IN THE TOTAL PRESSURE MODE

[75] Inventor: Jonathan H. Batey, Kingsley, England

[73] Assignee: VG Instruments Group Limited, England

[21] Appl. No.: 582,789

[22] Filed: Feb. 23, 1984

[30] Foreign Application Priority Data

Feb. 25, 1983 [GB] United Kingdom ..... 8305228

[51] Int. Cl.[3] ..... H01J 49/42

[52] U.S. Cl. ..... 250/292; 250/282

[58] Field of Search ..... 250/292, 290, 281, 282

[56] References Cited

U.S. PATENT DOCUMENTS

| | | | |
|---|---|---|---|
| 2,939,952 | 6/1960 | Paul et al. | 250/292 |
| 3,895,231 | 7/1975 | Sodal et al. | 250/288 |
| 3,926,209 | 12/1975 | Sodal et al. | 137/487.5 |
| 4,018,241 | 4/1977 | Sodal et al. | 137/14 |
| 4,234,791 | 11/1980 | Enke et al. | 250/281 |

FOREIGN PATENT DOCUMENTS

| | | |
|---|---|---|
| 0024149 | 2/1981 | European Pat. Off. . |
| 0023826 | 11/1981 | European Pat. Off. . |

OTHER PUBLICATIONS

G. Lawson et al., "Radiofrequency Quadrupole Mass Spectrometers" *J.F.J. Chem. Brit.*, 1972, 8, p. 373.

D. C. McGilvery et al., "A Mass Spectrometer for the Study of Laser-Induced Photodissociation of Ions", *Int. J. Mass Spectrom. and Ion Phys.*, 1978, 28, pp. 81–92.

M. Bergoglio et al., "Partial Pressure Measurements, Residual Gas Analysis in Ultra-high Vacuum and Problems of Pure Gass Transferring", *Adv. in Mass Spectrom.*, 1978, 7A, pp. 721–726.

Donald J. Jenden et al., "A Multiple Specific Ion Detector and Analog Data Processor for a Gas Chromatograph/Quadrupole Mass Spectrometer System", *J. Chrom. Sci.*, 1973, II, pp. 601–606.

*Primary Examiner*—Alfred E. Smith

*Assistant Examiner*—Jack I. Berman

*Attorney, Agent, or Firm*—Bacon & Thomas

[57] ABSTRACT

This invention relates to a method of operating quadrupole mass spectrometers with only an RF potential applied to the filter rods so that the spectrometer operates to pass all ions above a particular value of m/e. In practice, spectrometers operated in this way usually show a marked loss in transmission efficiency for ions of high m/e when operated with an RF potential low enough to pass ions of m/e < 10, and the invention overcomes this defect by providing a method of switching the RF potential between two or more values at which ions of different ranges of m/e values are efficiently transmitted, and combining the output signals at each value to give a resultant signal more accurately proportional to the number of ions formed in the source of the spectrometer, irrespective of their m/e values. The invention can be used to improve the accuracy of total pressure measurement using a conventional residual gas analyzing mass spectrometer, eliminating the need for additional pressure gauges.

17 Claims, 7 Drawing Figures

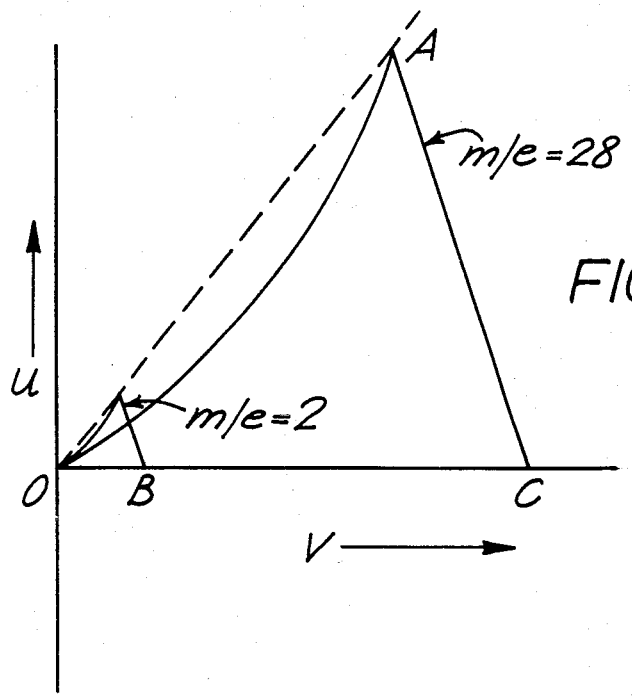
FIG.2.
FIG.3.
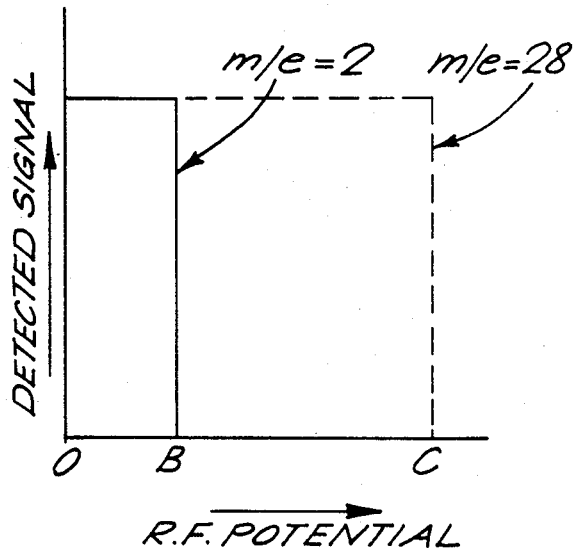

DETECTOR OUTPUT (ARBITRARY UNITS)
0
1
2
3
4
5
6
0
D
T.P.
10
20
30
40
50
60
R.F. POTENTIAL (≡ A.m.u, NORMAL QUADRUPOLE MODE)
H2
He
N2
AIR
CO2

APPARATUS FOR AND METHOD OF OPERATING QUADRUPOLE MASS SPECTROMETERS IN THE TOTAL PRESSURE MODE

TECHNICAL FIELD

This invention relates to quadrupole mass spectrometers, especially those used for monitoring the composition of residual gases in a vacuum system.

BACKGROUND ART

In all mass spectrometers, an ion source is used to generate an ion beam characteristic of the composition of the sample, and this ion beam is transmitted to an ion detector via a mass filter placed between the source and the detector. The mass filter may be one of several different types. A commonly employed type is based on a magnetic sector analyser, which selects ions on the basis of their momentum. The velocity of the ions passing through the sector must therefore be maintained at a constant value in order that the resolution is not degraded, and an electric sector analyser, which allows the passage only of ions having a particular kinetic energy, is often used in conjunction with a magnetic sector analyser for this purpose. In contrast, a quadrupole mass filter separates ions on the basis of their mass to charge ratios only, and involves the passage of the ions through an alternating electric field at radio frequency (RF). For certain applications, mass spectrometers based on this principle have a number of advantages over other types, especially where very high mass resolution is not required, and where fast scans of a range of masses is needed. A quadrupole mass filter consists of four electrically conductive electrode rods arranged symmetrically about, and very accurately parallel to the line joining the ion source to the detector. Opposite pairs of the rods are electrically connected together, and an electrical potential oscillating at radio frequency, together with a superimposed direct voltage, is applied between them. Designating three axes of rectangular coordinates x, y, and z, so that the x axis is the line joining the centres of the rods which are connected to the positive pole of the direct voltage supply, the y axis is the line joining the centres of the rods which are connected to the negative pole of the direct voltage supply, and the z axis is the line joining the ion source to the detector, then a positively charged ion entering the analyser along the z axis with a finite velocity will be subject to a combination of electrical forces and will describe a complex trajectory. This trajectory is best considered as the resultant of two motions, one in the y-z plane, and the other in the x-z plane. Assuming first that only the direct voltage is applied, then the motion of the ion in the x-z plane, where the rods are positively charged, will be simple harmonic in character, and the trajectory will be stable, that is, remaining finite in amplitude. However, the motion of the positive ion in the y-z plane, where the rods are negatively charged, will be divergent away from the z axis, with constantly increasing deviation, so that the trajectory is unstable and the ion will be lost by striking one of the rods. If, on the other hand, only the RF field is applied, then the trajectories in both planes will be alternately deflected towards and away from the z axis, and a stable trajectory in both planes is possible providing the frequency is high enough and the ion is heavy enough not to respond sufficiently during the defocussing part of the cycle to strike one of the rods. If both the direct voltage and the RF voltages are simultaneously applied, then the potential between the pairs of rods at any instant will be given by $$\phi = U + V\cos wt,$$

in which:

U is the direct voltage;

V is the zero-to-peak RF voltage;

and w is the angular frequency of the applied RF ($=2\pi f$, where f is the frequency in Hz.)

The light ions will be able to follow the alternating component. In the x-z plane they will tend to have unstable trajectories whenever the alternating component exceeds the direct component, and eventually strike the rods, so that only heavy ions will pass through the filter without being lost by striking the x electrodes. However, in the y-z plane, the trajectory of heavy ions tends to be unstable because of the defocussing effect of the direct component, but some of the lighter ion trajectories will be stable because they will be corrected by the RF component whenever their amplitude tends to increase. Thus the quadrupole filter acts as a combination of a high pass and a low pass mass filter, and will only transmit ions of a certain range of mass to charge (m/e) ratios. The behaviour of the filter can be treated theoretically, for example, as described by Paul et. al. in U.S. Pat. No. 2,939,952, and a drawing indicating the operating conditions where stable trajectories exist can be constructed. Such a drawing is shown in FIG. 1, which is a plot of a parameter a against parameter q, which are given by the expressions:

$$a = \frac{4eU}{mr_o^2w^2}$$

$$q = \frac{2eV}{mr_o^2w^2}$$

in which:

e is the charge on the electron;

m is the mass of the ion;

$r_o$ is the radius of the field (i.e., one half the distance between the inside surfaces of the rods); and U,V, and w are as defined previously.

Clearly, for ions to be transmitted through the filter, the ion trajectories in the x-z and y-z planes must be simultaneously stable, and for a given geometrical arrangement and frequency (i.e., $r_o$ and w constant), it is clear from FIG. 1 that transmission can occur in any of the regions where x stability and y stability regions overlap. However, in practice, only the cross shaded region close to the origin is used because of practical limitations.

The parameters a and q plotted in FIG. 1 are both inversely proportional to the m/e of the ion, and an alternative method of indicating the stable region is on a plot of U, the direct voltage, against V, the RF potential, for ions of particular m/e values, at constant $r_o$ and w. FIG. 2 shows two such plots, limited to the stable region close to the origin of FIG. 1, for ions of m/e=2 and m/e=28. It is clear from the figure that the maximum resolution, which corresponds to the minimum range of m/e values transmitted, is obtained by increasing the ratio of U/V to the point A. At this point the trajectories of ions only slightly heavier than the one transmitted become unstable in the y-z plane, and the trajectories of ions only slightly lighter then that transmitted become unstable in the x-z plane. From the above equations, it can be seen that $$a/q=2U/V$$

so that the point of maximum resolution is independent of the mass of the ion transmitted. The resolution can be lowered by reducing the value of U/V. FIG. 2 shows that the m/e ratio transmitted is dependent on V, but that the point of maximum resolution always occurs at the same ratio of U/V, as indicated by the dotted line. The quadrupole may therefore be scanned by varying V, but keeping the ratio U/V constant at a value which maintains the desired resolution. Alternatively, the U and V values may be scanned along a line parallel to the dotted line in FIG. 2, but displaced downwards slightly so that it cuts the V axis between points O and B. This mode of scanning results in peaks of a certain constant width, and is commonly used to obtain unit mass resolution over the entire mass range of the filter. It is the conventional mode of operating a quadrupole mass analyser.

In certain applications, however, including using a small quadrupole instrument for residual gas analysis, it is also useful to operate the quadrupole in the RF only mode, that is with U=0. In this mode, it acts as a broadband high pass mass filter, which passes all masses above a certain mass value. For example, referring to FIG. 2, an ion of m/e=28 will be transmitted if the RF voltage lies anywhere between points O and C, but an ion of m/e=2 will only be transmitted if the RF voltage is less than B. Operation of the quadrupole with an RF voltage below B, and U=0 should therefore result in the transmission of all ions above m/e=2, and the signal reaching the detector will be the sum of the intensities of all the ionized species produced by the source. In the case of a quadrupole used as a residual gas analyser in an ultra high vacuum system, this mode of operation can be used to produce a measure of the total pressure in the system, eliminating the need for a separate pressure gauge, such as an ion gauge. Other uses for quadrupoles used in the RF only mode include high efficiency transmission devices used to transmit all ions of a particular range of m/e values, for example in mass spectrometers used for the study of ion-molecule reactions, etc., such as that described in U.S. Pat. No. 4,234,791.

In practice, however, the behaviour of a real quadrupole analyser operated in this mode departs from the ideal. FIG. 3, which is a plot of the detected signal intensity against the RF potential V for ions of m/e=2 and m/e=28 suggests that in the ideal case, each ion is transmitted with the same efficiency over the range of RF potential values from 0 to the appropriate limiting value. However, curves for samples of hydrogen, helium, nitrogen, air, and carbon dioxide obtained in practice with a small quadrupole of the residual gas analysis type, shown in FIG. 4, differ considerably from the ideal shape shown in FIG. 3. The differences are probably caused by departures from ideal of the construction of the real quadrupole, for example, the use, to simplify manufacture, of rods of circular cross section in place of the hyperbolic rods required by the theory, and the use of simple ion sources which produce imperfectly collimated beams of ions with relatively large energy spreads. Defects in manufacture, e.g., imperfect rod alignment, may also contribute. It will be seen that the most important difference between the practical and theoretical curves is that the real quadrupole does not effectively pass ions at low values of the RF potential, and the cut-off occurs at a higher value for high mass ions such as nitrogen and carbon dioxide than for the low mass species such as hydrogen and helium. This is presumably because the focussing action of the RF field at low RF voltages is insufficient to overcome the defocussing of the beam due to the defects described. It is apparent from FIG. 4 that it is impossible to select a RF voltage which will effectively transmit both low and high mass ions simultaneously, because the value required to overcome the defocussing of the high mass ions is greater than the cut-off value for the low mass ions. However, if the RF voltage is set at the point TP in FIG. 4, the only ions not effectively transmitted will be hydrogen and helium, and in many cases, this will not be of importance. However, in other cases, for example the use of the filter as a residual gas analyser in an Ultra High Vacuum system, a serious error could be introduced in the total pressure reading because the residual gases at low pressures often contain a large proportion of hydrogen, and also helium when it is being used for leak checking.

It is the object of the present invention to provide a simple and economical method of overcoming this difficulty which allows the use of a simple quadrupole filter in the RF only mode to produce a signal which is proportional to the total ion current generated by the source, irrespective of the composition of the sample, thereby eliminating the need for an additional total pressure gauge such as an ion gauge.

SUMMARY OF THE INVENTION

In accordance with this objective the invention provides a method of determining the total pressure of a gas mixture present in the source of a quadrupole mass spectrometer having a detector and a mass filter to which only an RF potential is supplied, when the gas mixture contains components from which ions are formed which have maximum transmission efficiencies at different values of said RF potential, the improvement comprising maintaining the RF supply to said mass filter at a first potential at which ions of a first range of m/e values are efficiently transmitted and determining the ion current falling on said detector, and subsequently maintaining said RF supply at one or more further potentials at which ions of one or more further ranges of m/e values are efficiently transmitted and determining the ion current falling on the detector at each of said further potentials, and combining signals indicative of all said ion currents to produce an indication of the total pressure of the said gas mixture. Preferably two values of applied RF potential are selected so that ions of the lowest range of m/e values are efficiently transmitted at the lower applied RF potential, and ions of higher m/e values are efficiently transmitted at the higher applied RF potential. The potentials are preferably also chosen to minimize both the transmission of ions of high m/e values at the lower selected potential, and the transmission of ions of low m/e at the higher selected potential. In some cases, however, particularly when a sample gas mixture contains components of widely different molecular weights, three or more RF potentials may be employed.

Viewed from another aspect, the invention consists of a method of using a mass spectrometer having a detector and a quadrupole mass filter supplied only with an RF potential to measure the total pressure of the residual gases in a vacuum system comprising:

(a) positioning at least the ion source of said spectrometer in the said vacuum system;

(b) supplying said mass filter with a first RF potential at which ions formed from hydrogen and helium are efficiently transmitted through the filter, and generating a signal indicative of the ion current falling on said detector;

(c) in a separate, eg subsequent, operation supplying said mass filter with a second RF potential at which ions formed from higher molecular weight species such as nitrogen, oxygen, water, or carbon dioxide are efficiently transmitted through the filter, and generating a signal indicative of the ion current falling on said detector; and (d) combining said signals to produce an indication of the total pressure of said residual gases.

Viewed from a still further aspect, there is provided a mass spectrometer comprising an ion source, a mass filter of the quadrupole type capable of being supplied only with an RF potential so that it simultaneously transmits ions of a wide range of m/e values, and an ion detector arranged to produce a signal indicative of the intensity of the ion beam emerging from said mass filter, said mass filter incorporating means for switching said RF potential between a plurality of values selected so that at each potential ions of different ranges of m/e values are efficiently transmitted, and means for combining the signals from said detector generated at two or more of said selected values of RF potential to produce a signal indicative of the total number of ions generated by said ion source, irrespective of their m/e values. Thus, for example, if two values of RF potential are selected, corresponding to points D and TP in FIG. 4, when the potential is at D, ions derived from hydrogen and helium will be efficiently transmitted, and the signal from the detector will be largely determined by the hydrogen and helium in the sample, and when it is at value TP, the detector output will largely be determined by the higher molecular weight species such as ions derived from nitrogen, oxygen, water, and carbon dioxide. As previously explained, points D and TP are selected so that the contribution of the higher mass ions at point D, and the contribution of the low mass ions at point TP, are both minimised. If the signals obtained from the detector at points D and TP are then added together, the resultant signal will be proportional to the total pressure of all the gas entering the source, irrespective of its composition. Although the RF potential can be switched manually, and only one reading of the detector output taken at each setting of the RF voltage, it is preferable to switch the potentials repetitively and sum the resultant signal for a period of time. The switching of the RF potentials is easily achieved with most known types of RF power supply for quadrupole spectrometers. The voltage output of these is usually controlled by the application of a direct voltage to a control input, and to use the invention it is only necessary to apply a square wave control voltage of a suitable frequency (eg 75 Hz) to cause the RF voltage to be switched repetitively between the required values. The signal at the detector will then alternately correspond to the ion current at each of the applied RF potentials, and these signals can be added by suitable analogue circuitry, or simply averaged by use of a circuit with a long time constant relative to the frequency of switching. The resulting average signal can then be related to total pressure by calibration, comparing the mass spectrometer output with the total pressure readings indicated on an ion gauge or other total pressure gauge. Alternatively, a computer can be used to effect both the switching of the RF potentials and the combining of the signals produced by the detector, using suitable D-A and A-D converters. In this way the invention provides a simple way of improving the accuracy of the total ion current measurement made by a quadrupole spectrometer operating in the RF only mode, and in many cases eliminates the need for additional total pressure gauges. Alternatively, it is no longer necessary to provide a separate electrode for sampling the total ion current before the ions enter the source, which would reduce sensitivity in the conventional mode, nor the high sensitivity DC amplifier which this system requires. The invention also makes possible the use of more simple ion sources and mass filters than would be otherwise required to obtain satisfactory performance in the RF only mode, with a consequent reduction in manufacturing costs.

BRIEF DESCRIPTION OF THE DRAWINGS

Certain embodiments of the invention will now be described by way of example and with reference to the accompanying drawings, in which:

FIGS. 1–4 illustrate various aspects of the performance of both ideal and real quadrupole mass filters, and have already been described;

DETAILED DESCRIPTION OF THE INVENTION

Figure 5:
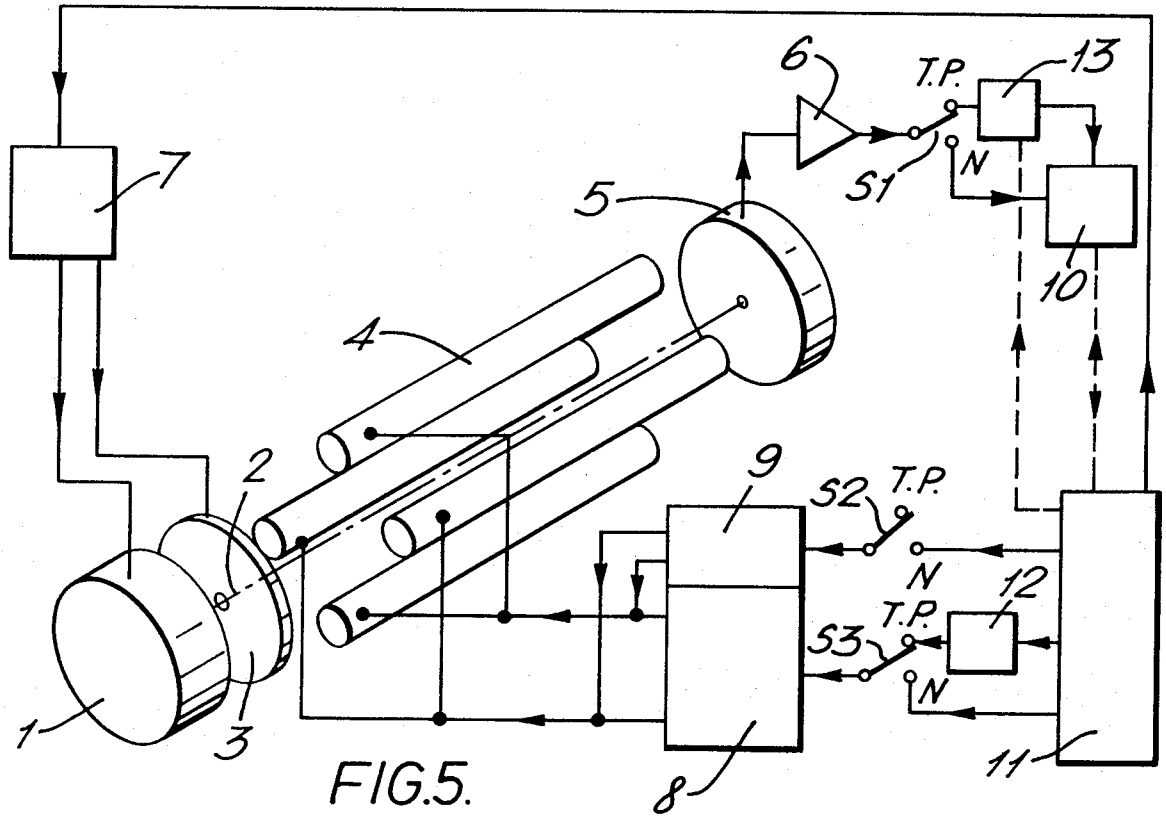
FIG. 5 illustrates a quadrupole mass spectrometer constructed according to the invention.

In FIG. 5, an ion source 1, which may be of any known type suitable for a quadrupole mass filter, generates a beam of ions 2 which pass through focussing electrodes 3 and quadrupole mass filter 4 to the ion detector 5. Detector 5 may conveniently be an electron multiplier, but other types, such as a Faraday cup detector, may be used, dependent on the application of the spectrometer. The electrical supplies required by ion source 1 are provided by the ion source power supply 7. The RF and DC potentials required by filter 4 are supplied by the RF generator 8 and DC generator 9. The signal from detector 5 is amplified by DC amplifier 6, and fed to an indicator system 10, which may be a meter, paper or UV chart recorder, or a computer based data acquisition system, dependent on the application of the spectrometer. Control module 11 provides control signals for the power supplies 7,8 and 9 as indicated, and controls the mass selected by the analyser and the parameters of the ion source 1. Module 11 may consist of analogue circuitry, or it may be a computer or microprocessor based device, possibly combined with the data acquisition system 10, if provided.

When the switches S1 to S3, FIG. 5, are in the "N" (normal) position, the system described comprises a conventional quadrupole spectrometer. In order to operate it in the "total pressure" mode, in accordance with the invention, the switches S1–S3 are set to the "TP" position, so that the DC supply 9 is isolated from the quadrupole rods, (or its output is set to zero by a signal from controller 11), and a square wave of suitable amplitude, from square wave generator 12, is applied to the RF generator 8 control input, so that its output is alternately switched between points D and TP in FIG. 4. Alternatively, the square wave may be generated directly by controller 11. The function of switches S1–S3 may also be carried out by controller 11.

The frequency of the square wave will be dependent on the required response time of the complete spectrometer to changes in the total pressure, and on the characteristics of detector 5, amplifier 6, and the signal combiner 13. Unless signal combiner 13 is a signal averager, the use of which is described below, then the frequency of the square wave should be low enough to allow detector 5 and amplifier 6 to respond to the changing signal, so that the output fed to combiner 13 will be a square wave with its upper and lower levels corresponding to the detected signal at points D and TP. Combiner 13 produces a signal which is the sum of these two levels, thus providing a signal which is more accurately proportional to the total ion current produced by source 1, as explained. It may do this in a number of ways, for example, it may contain conventional "sample & hold" circuit elements which store the maximum and minimum values of the detector output square wave, and an additive circuit which sums the outputs of the "sample & hold" elements. Alternatively, it may contain an A-D converter, which produces a digital output proportional to the two levels, which can be added digitally. This latter process is to be preferred when the mass spectrometer incorporates a computer based data acquisition system, in which case the converter will already be provided, and the summing can be done by the data system.

A further preferred method, especially suitable for low cost spectrometers which do not incorporate any form of data acquisition system, is to omit combiner 13 and increase the response time of amplifier 6 relative to the square wave frequency so that the output of amplifier 6 becomes proportional to the mean of the levels applied to its input. This approximately constant signal will be one-half of the value of the sum of the levels, providing that the mark-space ratio of the square wave is 1:1, and the system can be calibrated in terms of total pressure, etc, by comparing the displayed output in this mode with the reading of an ion gauge, etc. It may be more convenient to provide an additional amplifier of suitable response time in addition to amplifier 6, in place of combiner 13. The response time of the amplifier should be adjusted to smooth out most of the fluctuation of the square wave, but should not be increased too much, otherwise the overall response time of the spectrometer will be unnecessarily lengthened. Typically, a response time of 0.1–0.5 seconds will be adequate for a square wave of 75 Hz. The design of suitable circuits for sampling, adding, or averaging the signals will present no difficulty to those skilled in the art.

Figure 6:
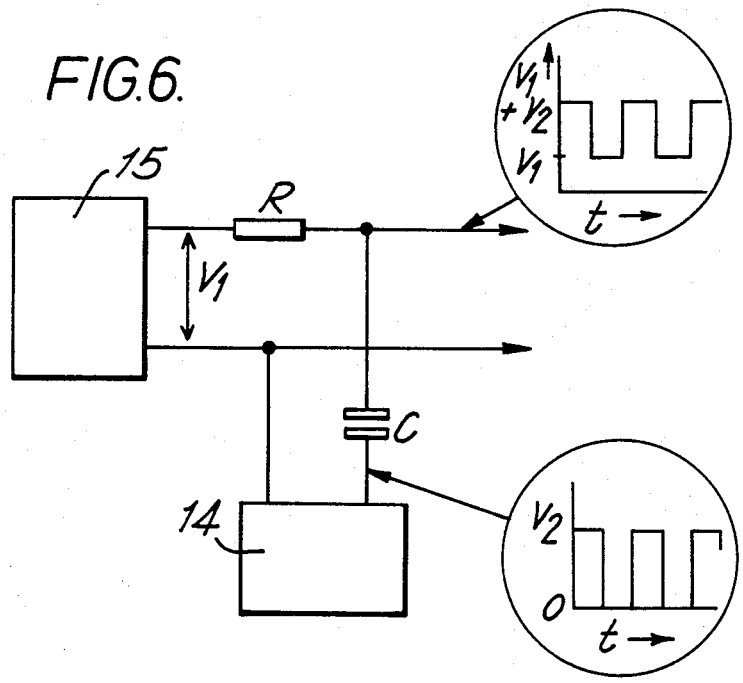
FIGS. 6 and 7 show simple methods of deriving a control signal useful in the operation of the invention.
Figure 7:
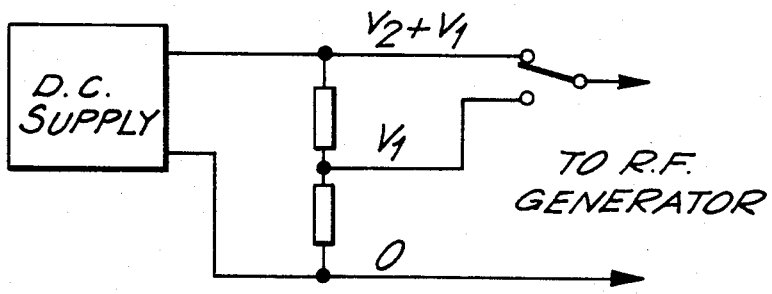

The switching of the levels of RF applied to the analyser is achieved by square wave generator 12. Clearly, the maximum and minimum values of the wave must correspond to the control signals required by RF generator 8 to produce the RF voltages corresponding to points D and TP in FIG. 4. FIG. 6 shows a very simple way of achieving this. A DC supply 15 with output voltage $V_1$ is used to offset the output of a simple square wave generator 14, of output voltage $V_2$, as shown, so that the output waveform consists of a square wave between $V_1$ and $V_1+V_2$. $V_1$ is selected to set the lower level of the square wave, and $V_2$ the upper level. The values of resistor R and capacitor C are selected to suit the characteristics of the supplies 14 and 15. As an alternative, if the spectrometer is provided with a computer based control system, this can be programmed to provide the required control voltages at the desired frequency. A further alternative arrangement is illustrated in FIG. 7, in which the switching is done automatically by a relay or digital switching device controlled by the computer, or manually in the case of very simple applications. Although there is some advantage in making the total pressure measurement using a relatively high switching frequency, in some cases it may be adequate to simply sum the two detector outputs obtained at just one setting of the RF voltage to each value, and a manual switching system can then be used.

Other ways of constructing the spectrometer control system especially to suit particular applications will be apparent to those skilled in the art.

Figure 1:
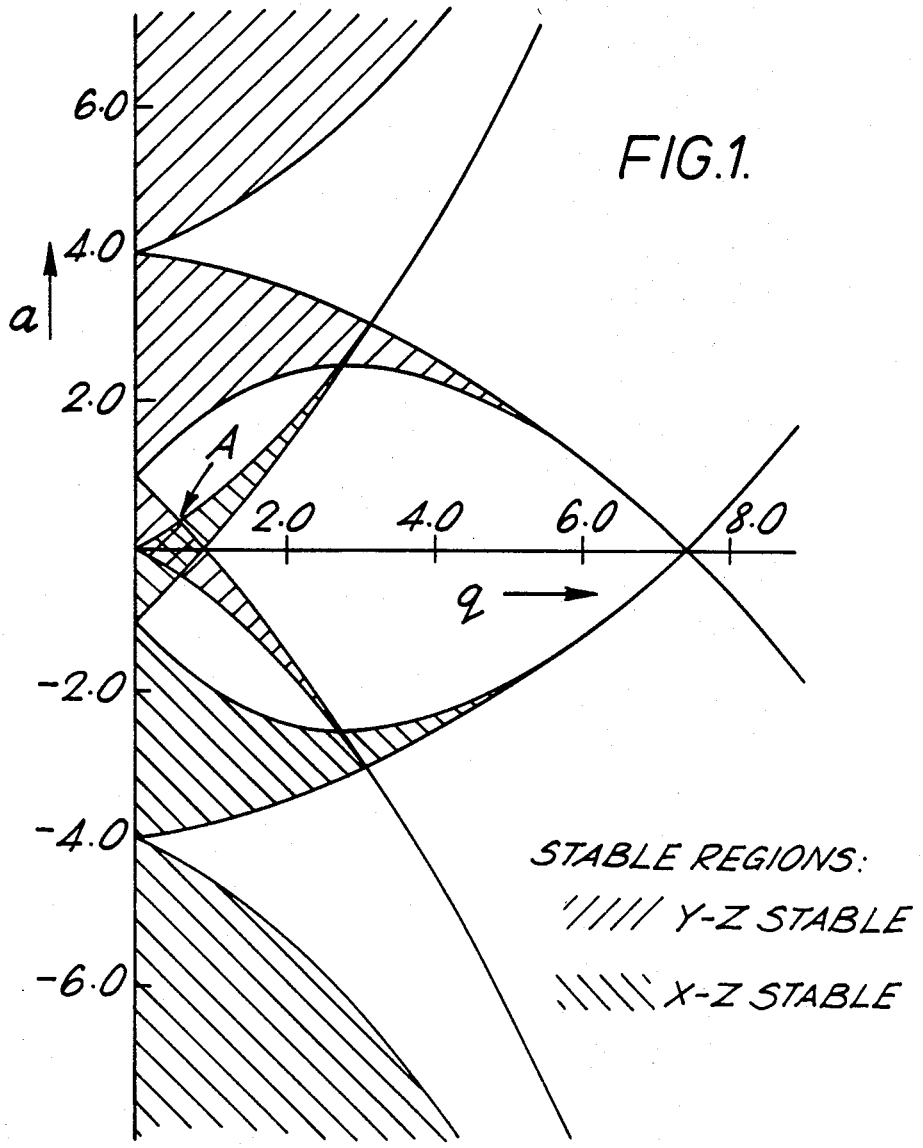
Figure 4:
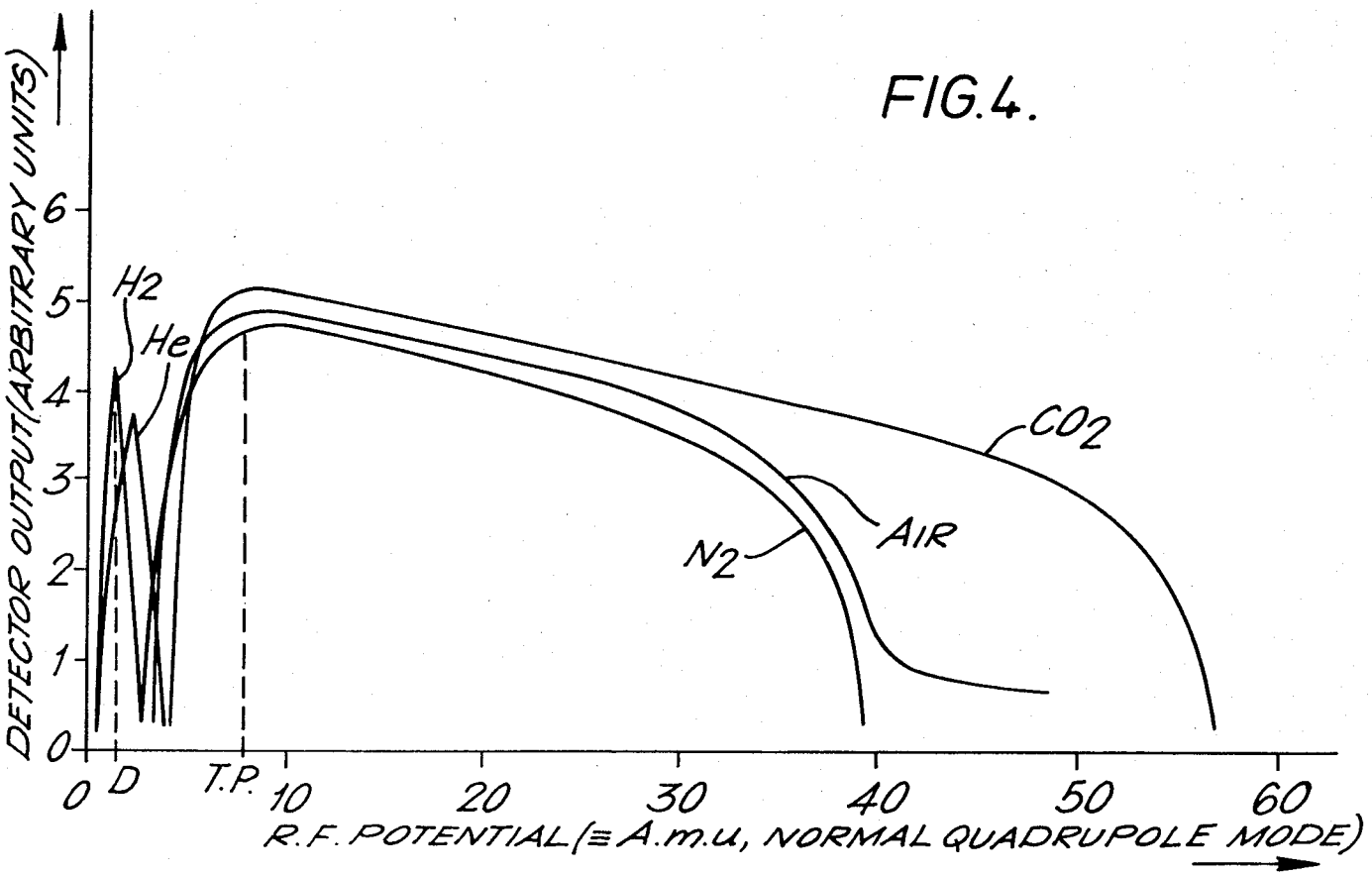

The selection of the points D and TP must be done by inspection of the sensitivity curves for the spectrometer operating in the total pressure mode, which will be similar to those shown in FIG. 4. They can be determined experimentally by admitting a pure sample gas into the spectrometer at a known pressure, and monitoring the detector output at different applied RF potentials. This should be done for a range of different samples. Points D and TP can then be selected so that the contribution from the higher mass ions to the ion current monitored at the lowest mass is minimised, and v.v, whilst still selecting values which are close to the peaks in the sensitivity curves. Clearly, if these curves overlap significantly at the selected values, an error will be introduced. In some cases where this occurs, the overlap may be reduced by applying a small DC voltage to the quadrupole rods to increase the resolution at one of the settings, but in general this is not necessary. In the case of use as a residual gas analyser, it will frequently found that the RF potentials required for maximum transmission of hydrogen and helium will be different, as shown in FIG. 4. In this case it is preferable to select the potential corresponding to maximum transmission of hydrogen, because hydrogen is an important constituent in the residual atmospheres of most high vacuum systems, whilst helium will only be present when helium leak checking is being undertaken, during which an accurate measure of total pressure will not be required. It will be further appreciated that the invention is not limited to summing the output at only two values of applied RF potential. If a very wide range of masses is to be monitored, it might be advantageous to sum or average the outputs at three or more values of RF potential. These values can be selected from the sensitivity vs. RF potential curves in a similar way to that described for two values. In general, however, this is unnecessary with the small spectrometers with which this invention is primarily concerned.

What is claimed is:

1. A method of determining the total pressure of a gas mixture present in the source of a quadrupole mass spectrometer having a detector and a mass filter to which only an RF potential is supplied, when the gas mixture contains components from which ions are formed which have maximum transmission efficiencies at different values of said RF potential, the improvement comprising maintaining the RF supply to said mass filter at a first potential at which ions of a first range of m/e values are efficiently transmitted and determining the ion current falling on said detector, and subsequently maintaining said RF supply at one or more further potentials at which ions of one or more further ranges of m/e values are efficiently transmitted and determining the ion current falling on the detector at each of said further potentials, and combining signals indicative of all said ion currents to produce an indication of the total pressure of the said gas mixture.

2. A method according to claim 1 in which two potentials are selected so that ions of the lowest range of m/e values are efficiently transmitted at the lower applied RF potential, and ions of higher m/e values are efficiently transmitted at the higher RF potential.

3. A method according to claim 2 in which said potentials are further selected to minimise the transmission of ions outside the range that each potential is primarily intended to transmit.

4. A method of using a mass spectrometer having a detector and a quadrupole mass filter supplied only with an RF potential to measure the total pressure of the residual gases in a vacuum system, said method comprising:

(a) positioning at least the ion source of said spectrometer in the said vacuum system;

(b) supplying said mass filter with a first RF potential at which ions formed from hydrogen and helium are efficiently transmitted through the filter, and generating a signal indicative of the ion current falling on said detector;

(c) in a separate operation, supplying said mass filter with a second RF potential at which ions formed from higher molecular weight species such as nitrogen, oxygen, water, or carbon dioxide are efficiently transmitted through the filter, and generating a signal indicative of the ion current falling on said detector; and (d) combining said signals to produce an indication of the total pressure of said residual gases.

5. A mass spectrometer comprising an ion source, a mass filter of the quadrupole type capable of being supplied only with an RF potential so that it simultaneously transmits ions of a wide range of m/e values, and an ion detector arranged to produce a signal indicative of the intensity of the ion beam emerging from said mass filter, said mass filter incorporating means for switching said RF potential between a plurality of values selected so that at each potential ions of different ranges of m/e values are efficiently transmitted, and means for combining the signals from said detector generated at two or more of said selected values of RF potential to produce a signal indicative of the total number of ions generated by said ion source, irrespective of their m/e values.

6. A mass spectrometer according to claim 5 in which said means for switching the RF potential is adapted to switch the RF potential between selected values repeatedly at a selected switching frequency and said means for combining the signals from the detector is adapted to add said signals to produce a resultant signal equal to the sum of the intensities of the ions transmitted by the filter at each value of RF potential.

7. A mass spectrometer according to claim 5 in which said means for switching the RF potential is adapted to operate at a selected switching frequency and in such a way that each of said RF potentials is selected for substantially the same period of time, and said means for combining the signals from the detector is adapted to produce a resultant signal which is the average of the signals generated by the detector at each of said values of RF potential.

8. A mass spectrometer according to claim 5 in which said means for switching is adapted to switch said RF potential between two values, one of which is selected to result in efficient transmission of ions derived from hydrogen and helium, and the other of which is selected to result in efficient transmission of higher mass ions such as those derived from nitrogen, oxygen, water and carbon dioxide.

9. A mass spectrometer according to claim 6 in which said means for switching is adapted to switch said RF potential between two values, one of which is selected to result in efficient transmission of ions derived from hydrogen and helium, and the other of which is selected to result in efficient transmission of higher mass ions such as those derived from nitrogen, oxygen, water and carbon dioxide.

10. A mass spectrometer according to claim 7 in which said means for switching is adapted to switch said RF potential between two values, one of which is selected to result in efficient transmission of ions derived from hydrogen and helium, and the other of which is selected to result in efficient transmission of higher mass ions such as those derived from nitrogen, oxygen, water and carbon dioxide.

11. A mass spectrometer according to claim 5 having a means for generating said RF potential, the output of which is controlled by a direct potential applied to a control input, and in which said means for switching comprises means for generating and applying to said control input a repeating waveform potential having periods of constant potential each selected to cause said means for generating said RF potential to generate one of said plurality of values of RF potential.

12. A mass spectrometer according to claim 6, further comprising computer control means arranged to control the operation of said means for generating said RF potential and said ion detector wherein said means for switching comprises said computer control means operating under a first program and said means for combining comprises said computer control means operating under a second program in cooperation with said first program.

13. A mass spectrometer according to claim 5 which is additionally provided with means enabling it to operate as a conventional quadrupole mass spectrometer, and mode switching means enabling selection of the conventional mode or the RF only mode.

14. A mass spectrometer according to claim 6 which is additionally provided with means enabling it to operate as a conventional quadrupole mass spectrometer, and mode switching means enabling selection of the conventional mode or the RF only mode.

15. A mass spectrometer according to claim 7 which is additionally provided with means enabling it to operate as a conventional quadrupole mass spectrometer, and mode switching means enabling selection of the conventional mode or the RF only mode.

16. A mass spectrometer according to claim 11 which is additionally provided with means enabling it to operate as a conventional quadrupole mass spectrometer, and mode switching means enabling selection of the conventional mode or the RF only mode.

17. A mass spectrometer according to claim 12 which is additionally provided with means enabling it to operate as a conventional quadrupole mass spectrometer, and program means enabling selection of the conventional mode or the RF only mode.

* * * * *